United States Patent [19]

Georget et al.

[11] 4,361,289

[45] Nov. 30, 1982

[54] JAW CRUSHER

[75] Inventors: Jean-Pierre Georget; Roger Lambrecht, both of Denain, France

[73] Assignee: Fives-Cail Babcock, Paris, France

[21] Appl. No.: 169,361

[22] Filed: Jul. 6, 1980

[30] Foreign Application Priority Data

Jul. 6, 1979 [FR] France ..... 79 17557

[51] Int. Cl.[3] ..... B02C 1/04

[52] U.S. Cl. ..... 241/32; 241/264

[58] Field of Search ..... 241/32, 37, 262–269

[56] References Cited

U.S. PATENT DOCUMENTS 3,386,667 6/1968 May ..... 241/264 X
3,511,444 5/1970 Vitez ..... 241/264 X
3,804,345 4/1974 De Diemar ..... 241/264

FOREIGN PATENT DOCUMENTS 1131972 6/1962 Fed. Rep. of Germany ..... 241/269
2356744 5/1975 Fed. Rep. of Germany ..... 241/264
599274 1/1926 France .
790508 11/1935 France .

*Primary Examiner*—Howard N. Goldberg
*Attorney, Agent, or Firm*—Kurt Kelman

[57] ABSTRACT

One end of the mobile jaw of a jaw crusher is supported on the crusher frame by an eccentric shaft and a connecting rod supports the other mobile jaw end on a crossbeam pivotally mounted on the frame. The crossbeam has a rear extension accessible from outside the frame and a control wedge is positioned on a bracket affixed to the frame between the bracket and the crossbeam extension. A safety system acts on the crossbeam extension for preventing pivoting thereof when the force applied by the mobile jaw to the crossbeam remains below a predetermined value, the safety system pressing the crossbeam extension against the control wedge.

5 Claims, 2 Drawing Figures

JAW CRUSHER

Figure 1:
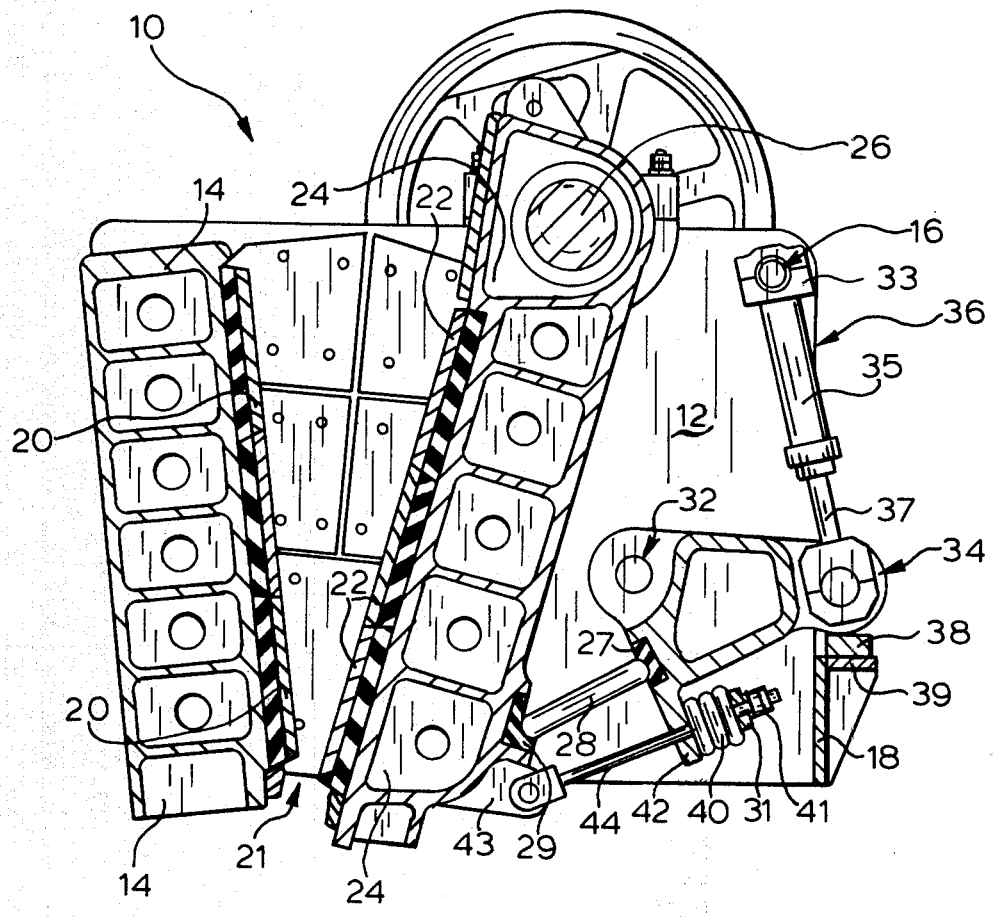

The present invention relates to jaw crushers comprising a frame, a stationary jaw carried by the frame, a mobile jaw associated with the stationary jaw and defining a crushing gap therewith, an eccenter shaft supporting one end of the mobile jaw on the frame, a crossbeam mounted on the frame and a connecting rod or toggle supporting the other mobile jaw end on the crossbeam. The position of the crossbeam in relation to the frame is adjustable to change the distance between the jaws, i.e. the size of the crushing gap. A safety system permits the mobile jaw to recoil when the pressure it exerts on the connecting rod exceeds a predetermined value, for example because an unbreakable piece is in the crushing gap.

In the illustrated jaw crusher, the crossbeam is pivotally mounted on the frame for pivoting about an axis parallel to the eccenter shaft and the safety system acts on the crossbeam to prevent it from pivoting when the force applied by the mobile jaw to the crossbeam remains below a predetermined value.

In known apparatus of this type, the crossbeam is comprised of two parts which are linked together and connected by a breakable bolt, the mobile jaw being supported through a connecting rod by one crossbeam part while the other crossbeam part is itself supported through a connecting rod by the frame so that the forces acting on the mobile jaw are transmitted to the frame by the breakable bolt which constitutes the safety system. The gap size control is effected by means of wedges positioned between the frame and the end of the connecting rod supported thereon. In this apparatus, all the adjustment and safety means are located inside the frame and, therefore, are not readily accessible, which complicates the control operations and the restoration of the safety system after the bolt has been broken. The latter operation is particularly time-consuming because the mobile jaw and the connecting rods must be replaced, which in large crushers involves very heavy pieces.

In another type of jaw crusher, the jaw is supported on a crossbeam whose ends are connected to one of the arms of two levers pivotally mounted on the side plates of the frame, the other arms of the levers being fixed to an arcuate sector affixed to the frame by means of a bolt whose tension is controlled so that the fixation may yield and, therefore, permit the pivoting of the levers and the recoil of the jaw when the forces exerted thereon exceed a given limit. In this apparatus, the operation of the safety system depends on the extent of the tension of the bolt fixing the levers to the sectors affixed to the frame and on the surface conditions of the elements in contact with each other so that the limit of the forces supported by the jaw cannot be precisely set. Furthermore, after the safety system has acted, it is necessary to reset the position of the jaw by untightening the bolts, returning the levers to their original positions and tightening the bolts again.

It is the primary object of this invention to overcome these disadvantages of known jaw crushers and to provide a control and safety system which operates dependably and makes it possible to adjust the position of the mobile jaw readily and rapidly.

The invention accomplishes the above and other objects in a jaw crusher of the first-described type with a pivotally mounted crossbeam which has a rear extension extending in a direction opposite to that of the connecting rod and being accessible from outside the frame, a bracket affixed to the frame, control wedge means positioned on the bracket between the bracket and the crossbeam extension, and a safety system acting on the crossbeam extension for preventing pivoting thereof when the force applied by the mobile jaw to the crossbeam remains below a predetermined value, the safety system pressing the crossbeam extension against the control wedge means. The crossbeam extension acts like a lever to which the safety system is connected and the thickness of the control wedge means determines the distance of the mobile jaw from the stationary jaw, i.e. the crushing gap size.

Figure 2:
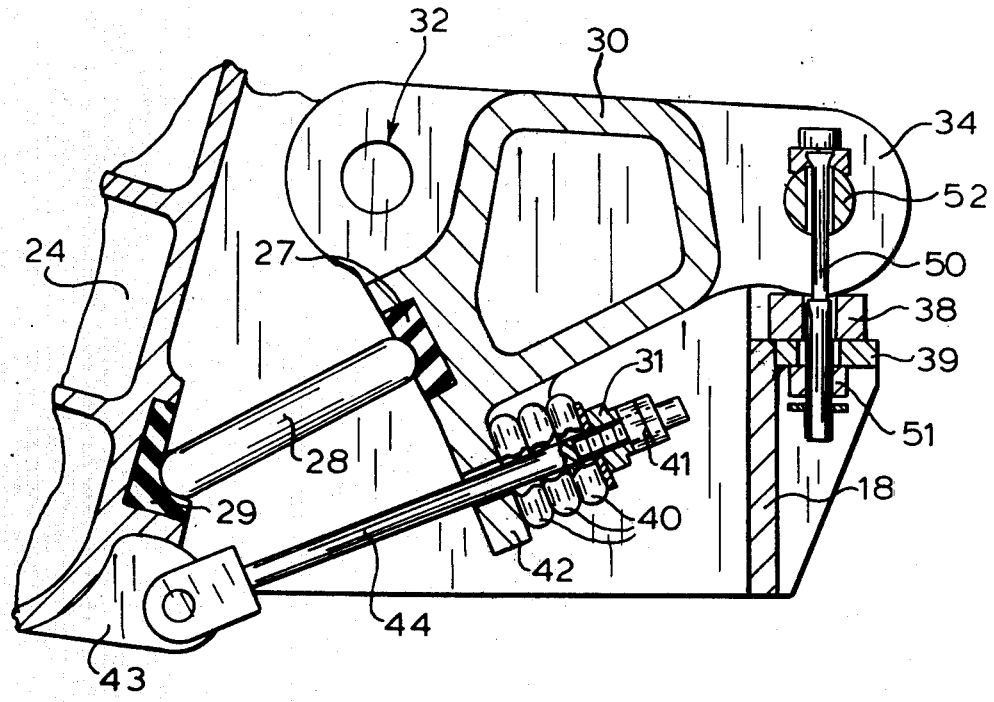

The above and other objects, advantages and features of the present invention will become more apparent in the following detailed description of two now preferred embodiments thereof, taken in conjunction with the accompanying drawing showing only essential portions of a jaw crusher and wherein FIG. 1 is a vertical section of a jaw crusher incorporating a control and safety system according to one embodiment of this invention, and FIG. 2 is a like section on a larger scale, showing another embodiment of the control and safety system.

Referring now to the drawing and first to FIG. 1, the illustrated jaw crusher is shown to comprise frame 10 having two side plates 12 and rear plate 18. The two side plates of the frame are braced by casing wall 14 which constitutes the bed for stationary jaw 20. Transverse bracing pipe 16 extends between side plates 12 near the rear of the frame above rear plate 18. Mobile jaw 22 is affixed to casing carrier 24 and the two jaws define crushing gap 21 therebetween. Eccentric shaft 26 has its ends journaled in bearings affixed to side plates 12 of frame 10 and supports the upper end of mobile jaw carrier 24 for swinging movement of the jaw.

Crossbeam 30, extending parallel to eccenter shaft 26, is pivotally mounted on frame 10, the illustrated mounting being comprised of stub shafts 32 at the respective ends of the crossbeam and rotatably journaled in bearings affixed to the side plates. Connecting rod or toggle 28 supports the lower end of mobile jaw carrier 24 on cross beam 30, respective seats 27 and 29 being affixed to the crossbeam and to the mobile jaw carrier to receive the ends of the connecting rod. The eccentric shaft and crossbeam supports for the mobile jaw are located inside frame 10.

Crossbeam 30 has rear extension 34 extending in a direction opposite to that of connecting rod 28 and being accessible from outside frame 10, the crossbeam rear extension constituting a bearing means for the safety system to be described hereinafter. The crossbeam and its rear extension constitutes a lever pivoting about an axis defined by stub shafts 32 for adjustably supporting the lower end of mobile jaw 22 through rod 28, the pivoting angle of the support determining the size of crushing gap 21. Bracket 39 is affixed to rear plate 18 of frame 10 and a control wedge means illustrated by replaceable wedge 38 is positioned on bracket 39 between the bracket and crossbeam extension 34 to delimit the pivoting angle by acting as a stop on crossbeam extension 34 in its pivoting motion. The thickness of wedge 38 determines the adjustability of this crushing gap setting mechanism.

The embodiment of the safety system illustrated in FIG. 1 includes a pair of hydraulic jacks 36 each having cylinder element 35 and piston rod element 37, one of the jack elements being linked to frame 10 and the other jack element being linked to crossbeam extension 34. In the illustrated embodiment, jack cylinder 35 is linked by clamping members 33 to transverse bracing pipe 16 while piston rod 37 of each jack is linked to a respective crossbeam extension 34. In this manner, safety system jacks 36 are mounted for oscillation in vertical planes.

The chambers of the jack cylinders defined between the pistons gliding inside the cylinders and affixed to the piston rods are connected to a conventional hydro-pneumatic accumulator (not shown) in which a predetermined pressure is maintained. This pressure is transmitted to the pistons in the safety system jacks so that the jacks act on crossbeam extension 34 for preventing pivoting thereof as long as the force applied by mobile jaw 22 to crossbeam 30 remains a predetermined value corresponding to the normal operating conditions of the crusher. During these normal operating conditions, the safety system jacks press crossbeam extension 34 against control wedge means 38 which set the crushing gap size. The thickness of the control wedge means determines the pivoting angle of crossbeam 30 and its extension 34 and thus controls and adjusts the distance of mobile jaw 22 from stationary jaw 20. In the illustrated embodiment, the crossbeam extension extends through rear plate 18 of frame 10 and bracket 39 is affixed to the rear plate so that the setting and safety mechanisms are readily accessible from outside frame 10.

As shown in the drawing, rod 28 is maintained under compression between carrier bed 24 of mobile jaw 22 and supporting crossbeam 30. The illustrated mechanism producing this compression of the connecting rod comprises an elastic means carried by the crossbeam and acting on the mobile jaw through tension rod means connected to the mobile jaw. The exemplified elastic means are air cushions 40 mounted on bracket 42 affixed to crossbeam 30. Tension rods 44 have one end linked to bracket 43 affixed to the lower end of mobile jaw carrier 24 and the opposite end passing through bores in bracket 42, the opposite end threadedly receiving nut 41 which presses washer 31 against the air cushions to maintain the same on bracket 42.

When the force exerted by swinging jaw 22 on pivotal crossbeam 30 exceeds the counterforce exerted upon crossbeam extension 34 by safety system jacks 36, i.e. the pressure prevailing in the jacks and determined by the hydro-pneumatic accumulator connected thereto, the crossbeam and extension will be pivoted counterclockwise, thus permitting the swinging jaw to recoil and the size of crushing gap 21 to increase. The pressure in the accumulator and correspondingly in the safety system jacks is so selected that no pivoting movement of the crossbeam and its extension will be permitted under normal operating conditions but will permit this pivoting when, for instance, an unbreakable body is introduced into the crushing gap. Due to the operation of the safety system, such a body will pass through the gap upon pivoting of crossbeam support 30. As soon as the body has passed through the crushing gap and normal operating conditions are restored, the swinging jaw will be automatically restored to its original setting under the pressure of jacks 36 pressing crossbeam extension 34 against wedge 38.

When it is desired to adjust the crushing gap size, i.e. the distance of the lower end of mobile jaw 22 from stationary jaw 20, the upper cylinder chambers of jacks 36 are decompressed and pressure is delivered to the lower cylinder chambers so as to pivot extension 34 away from wedge 38. The wedge may now be removed and replaced by wedge means of a different thickness, the same result being achieved by simply adding a wedge or by entirely removing the wedge means so that extension 34 will bear directly on bracket 39 for obtaining a minimum crushing gap. This adjustment operation is greatly facilitated by the fact that bracket 39 and wedges 38 are readily accessible outside frame 10. After this simple adjustment has been completed, the pressure in the cylinder chambers of jacks 36 is reversed again so that the jacks will press crossbeam extensions 34 down in a clockwise direction.

FIG. 2 shows another embodiment of the safety system, like structural elements functioning in a like manner being designated by the same reference numerals as in FIG. 1 to avoid redundancy in the description. In this embodiment, jacks 36 are replaced by breakable bolts 50 interconnecting frame 10 and crossbeam extension 34, the bolts being breakable under a predetermined pressure. In the illustrated embodiment, a plurality of crossbeam extensions are interconnected by axle 52 extending parallel to crossbeam 30 and bolts 50 pass through diametrical bores in the axle and bores in control wedge 38 and bracket 39 aligned therewith, the outer ends of the bolts threadedly receiving nuts 51 to hold the bolts in position. The cross section of the bolts is so selected that the bolts will break when the force exerted by the mobile jaw on the crossbeam exceeds a predetermined value. Thus, the operation of this safety system is functionally equivalent to the jacking system of FIG. 1.

In resetting the crushing gap size in this embodiment, a jacking tool is used to pull crossbeam extension 34 up after the broken bolts 50 have been removed. The control wedges are then put in place, as previously described, new breakable bolts 50 are inserted and the crossbeam is pivoted clockwise, all in the same manner as in the previously described embodiment.

While specific structural embodiments have been described and illustrated, it will be understood by those skilled in the art that various equivalent modifications may be provided without departing from the spirit and scope of the present invention as defined in the appended claims.

What is claimed is:

1. A jaw crusher comprising a frame, a stationary jaw carried by the frame, a mobile jaw associated with the stationary jaw and defining a crushing gap therewith, the mobile jaw having two ends, an eccentric shaft supporting one end of the mobile jaw on the frame, a crossbeam pivotally mounted on the frame, a connecting rod supporting the other end of the mobile jaw on the crossbeam, the crossbeam having a rear extension, the rear extension and the connecting rod extending in opposite direction from the crossbeam and being accessible from outside the frame, a bracket affixed to the frame, control wedge means positioned on the bracket between the bracket and the crossbeam extension, a safety system acting on the crossbeam extension for preventing pivoting thereof when the force applied by the mobile jaw to the crossbeam remains below a predetermined value, the safety system pressing the crossbeam extension against the control wedge means.

2. The jaw crusher of claim 1, wherein the frame has two side plates and a rear plate, the stationary jaw being carried by the side plates, the eccentric shaft being journaled in the side plates, the crossbeam being pivotally mounted on the side plates, the crossbeam extension extending through the rear plate, and the bracket being affixed to the rear plate.

3. The jaw crusher of claim 1 or 2, wherein the safety system includes a hydraulic jack having a cylinder element and a piston rod element, one of the jack elements being linked to the frame and the other jack element being linked to the crossbeam extension, the hydraulic pressure in the jack being maintained at a predetermined pressure value.

4. The jaw crusher of claim 1 or 2, wherein the safety system includes a breakable bolt interconnecting the frame and the crossbeam extension and breakable under a predetermined pressure.

5. The jaw crusher of claim 1 or 2, further comprising elastic means carried by the crossbeam and acting on the mobile jaw through tension rod means connected to the mobile jaw, the elastic means maintaining the connecting rod under compression.

* * * * *